US011683633B1

(12) United States Patent
Stohr

(10) Patent No.: US 11,683,633 B1
(45) Date of Patent: Jun. 20, 2023

(54) METHOD AND APPARATUS FOR HEARING SOUNDS THROUGH VIBRATION

(71) Applicant: Luis Stohr, Redondo Beach, CA (US)

(72) Inventor: Luis Stohr, Redondo Beach, CA (US)

( * ) Notice: Subject to any disclaimer, the term of this patent is extended or adjusted under 35 U.S.C. 154(b) by 0 days.

(21) Appl. No.: 17/975,262

(22) Filed: Oct. 27, 2022

(51) Int. Cl.
*H04R 25/00* (2006.01)
*H04R 1/14* (2006.01)
*H04R 1/10* (2006.01)

(52) U.S. Cl.
CPC ..... *H04R 1/14* (2013.01); *H04R 1/1025* (2013.01); *H04R 2460/13* (2013.01)

(58) Field of Classification Search
CPC .. A63B 71/085; H04R 25/604; H04R 25/606; H04R 2460/13
See application file for complete search history.

(56) References Cited

U.S. PATENT DOCUMENTS 238,576 A * 3/1881 Davega ..... A61F 11/30 181/127
608,255 A * 8/1898 Gardner ..... A61F 11/30 181/127
1,521,287 A * 12/1924 Gernsback ..... H04R 25/00 381/396
4,071,110 A * 1/1978 Payne ..... G10K 11/025 381/151
5,447,489 A * 9/1995 Issalene ..... H04R 25/606 381/326
5,455,842 A * 10/1995 Mersky ..... B63C 11/26 381/151
5,460,593 A * 10/1995 Mersky ..... H04R 25/606 381/322
5,579,284 A * 11/1996 May ..... H04R 1/14 340/850
5,706,251 A * 1/1998 May ..... H04R 1/14 340/850
5,913,815 A * 6/1999 Ball ..... H04R 25/606 600/25
6,115,477 A * 9/2000 Filo ..... A63H 5/00 381/151
6,633,747 B1 * 10/2003 Reiss ..... A61C 7/00 455/66.1
8,270,638 B2 * 9/2012 Abolfathi ..... G01P 15/0891 381/151

(Continued)

FOREIGN PATENT DOCUMENTS

CN 2684504 Y * 3/2005
EP 0487599 B1 * 11/1994

(Continued)

*Primary Examiner* — Ryan Robinson
(74) *Attorney, Agent, or Firm* — Che-Yang Chen; Law Office of Michael Chen

(57) ABSTRACT

A mouth piece to transmit sound through vibration may include a front portion and a rear portion, which are connected through a connecting unit with each other to form a U-shaped apparatus. In one embodiment, the mouth piece can be disposed traversing the lower lip. More specifically, the front portion is disposed in front of the lower lip and the rear portion is disposed between the lower lip and the gum behind the lower lip, while the connecting unit is located between the upper lip and lower lip. The mouth piece may further include an extending piece extending from the rear portion into the mouth for the upper tooth and lower tooth to bite on.

5 Claims, 3 Drawing Sheets

(56) References Cited

U.S. PATENT DOCUMENTS

| | | | | |
|---|---|---|---|---|
| 8,295,506 | B2 | 10/2012 | Kassayan et al. | |
| 8,325,964 | B2 | 12/2012 | Weisman | |
| 9,219,955 | B2 * | 12/2015 | Imran | H04R 1/46 |
| 9,744,000 | B2 * | 8/2017 | Lanfried | A61C 13/01 |
| 10,117,010 | B2 * | 10/2018 | Spector | H04R 1/028 |
| 11,389,113 | B2 * | 7/2022 | Gonzales | B29C 51/30 |
| 2016/0234611 | A1 * | 8/2016 | Andersson | H04R 25/554 |
| 2016/0346603 | A1 * | 12/2016 | Halliday | A61M 16/208 |
| 2017/0070797 | A1 * | 3/2017 | Spector | A63B 71/085 |
| 2022/0054243 | A1 * | 2/2022 | Beckman | A46B 9/045 |
| 2022/0183625 | A1 * | 6/2022 | Gonzales | G01L 5/0052 |

FOREIGN PATENT DOCUMENTS

| | | | | |
|---|---|---|---|---|
| JP | H06191480 | A * | 7/1994 | |
| WO | WO-2009072107 | A2 * | 6/2009 | H04R 25/405 |

* cited by examiner

METHOD AND APPARATUS FOR HEARING SOUNDS THROUGH VIBRATION

FIELD OF THE INVENTION

The present invention relates generally to a method of transferring sound as vibrations from outside on the lip through the cranial bones into the inner hearing organ in the brain, so the exposed individual is be able to perceive sound other than transferred through air into the ear.

BACKGROUND OF THE INVENTION

The human ear generally comprises three regions: the outer ear, the middle ear, and the inner ear. The outer ear generally comprises the external auricle and the ear canal, which is a tubular pathway through which sound reaches the middle ear. The outer ear is separated from the middle ear by the tympanic membrane (eardrum). The middle ear generally comprises three small bones, known as the ossicles, which form a mechanical conductor from the tympanic membrane to the inner ear. Finally, the inner ear includes the cochlea, which is a fluid-filled structure that contains a large number of delicate sensory hair cells that are connected to the auditory nerve.

Using RF (Radio Frequency) from the source of the sound, for example, a MP3 Player was a great scientific progress that has been standardized by the Bluetooth technology. Of course any RF modulation signal can have the same sound signal transfer process using Bluetooth standard and its demand made the wireless sound signal transfer more affordable.

Anyhow, the sound signals used is transferred as electrical signals, transformed to mechanical signals to activate the excursion of a speaker that will emit air pressure waves that travel through the air into the ear cavity to be perceived. The apparatus developed in the present invention will avoid the need to emit air pressure waves representing the sound signal from the mouth into the hearing organ through fluids, teeth and bones in the brain. This approach will be practical since the device that emits the vibration is secured inside the mouth cavity instead of been fixed outside the listener brain of located on the listened ear such as headphones and ear plugs. The present invention can also be applied to humans and animals, also solves disable/handicap hearing conditions by using a microphone (stereo if needed) and amplified to drive the transducers.

One of the advantages of the present invention is that while the signal is perceived through vibrations inside the head, the hearing organ still properly functions and any acoustic signal perceived through air by the hearing organ will be added to the vibrations inside the head. In other words, the vibrations from the mouth cavity and the audio coming through the ear can be perceived simultaneously.

Another advantage of the present invention is that the apparatus in the present invention is secured on the mouth instead of hanging from the head (headphones) or pressuring over the ear (earplugs). The apparatus is especially convenient when an individual is doing sports where there is a lot of shaking or moving, or sleeping when the head and the ears need to be without anything mounted thereon.

If an individual has difficulties hearing sound signals through air because his ear drum or the middle ear is damaged, the apparatus in the present invention can help the individual listen the sound source or, by using a microphone with a simple amplifier, external sounds signals through air can be perceived.

SUMMARY OF THE INVENTION

It is the main objective of the present invention to provide an apparatus to listen sound through the teeth and bones, but not through air to the ear.

It is another objective of the present invention to provide an apparatus to cover not only one way but also bidirectional signal transmissions of audio and data signals. Namely, the apparatus not only receives and reproduce sound signals but also contains a microphone that collects sounds and transmits back to the audio source for a bidirectional application.

In one aspect, a mouth piece to transmit sound through vibration may include a front portion and a rear portion, which are connected through a connecting unit with each other to form a U-shaped apparatus. In one embodiment, the mouth piece can be disposed traversing the lower lip. More specifically, the front portion is disposed in front of the lower lip and the rear portion is disposed between the lower lip and the gum behind the lower lip, while the connecting unit is located between the upper lip and lower lip. The mouth piece may further include an extending piece extending from the rear portion into the mouth for the upper tooth and lower tooth to bite on.

In one embodiment, Bluetooth technology can be used to receive the sound signals from a source device, and the mouth piece can electrically amplify the signals through an amplifier, so an efficient speaker (small with relatively high output) is configured to create vibration on one or more transducers located at the front portion. It is noted that the mouth piece is disposed 90% located outside the mouth, namely out next to the lower lip, and only 10% goes inside as a plate. The transducer is outside of the mouth and only the plate goes inside between the "inner Labial Harvest site" and the "Front Gingivae" (gums), at the "Vermillion."

More specifically, the function of the transducer is to reproduce the sound source(s) as vibrations that can be transmitted to the extending piece and to at least one upper tooth and one lower tooth that bite on the extending piece. In one embodiment, the vibration can go to the Maxilla bone, the Sphenoid bone and the Mastoid bone, where vibrations are perceived by the individual or animal left and right hearing organs located in the brain.

It is noted that vibrations can not only be received by the upper tooth and the Maxilla bone, but also by the lower tooth and the Mandible bone. The individual or animal will be able to perceive the sound signal through vibrations generated by the transducers on the mouth piece 100 in the present invention.

In one embodiment, the material used for the transducer can be Nylon, but other materials that can minimize the degradation generated by the continuous friction of the teeth are also preferred. Also, a Left minus Right circuit can be added to the mouth piece to enhance the stereo effect. The Left minus Right circuit can be created using the left and right channels amplifiers by adding a portion of the left signal to the input of the right amplifier and vise versa for the right signal.

The present invention is advantageous because it offers an alternative for perceiving sound from the mouth piece located mainly outside the mouth, and the sound can be transmitted through vibrations perceived by the hearing organ through teeth and bones in the brain. This sound transmission route will be more practical, convenient and efficient since sound waves transport more efficiently through fluids and solids than gasses line in the air.

DETAILED DESCRIPTION OF THE INVENTION

Figure 1:
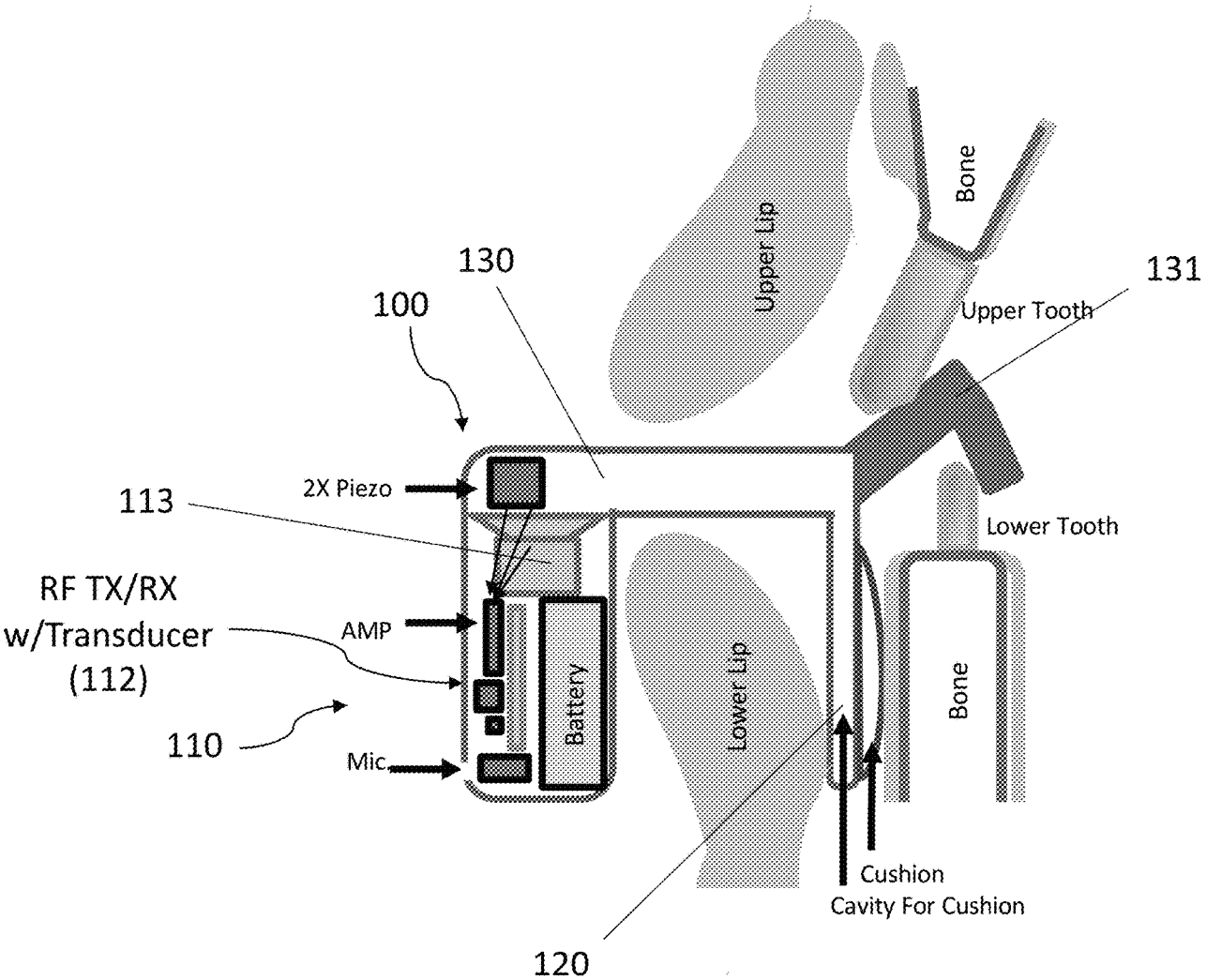
FIG. 1 illustrates a schematic view of the mouth piece to transmit sound through vibration in the present invention.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the embodiments. As used herein, the term "and/or" includes any and all combinations of one or more of the associated listed items.

As stated above, the present invention relates generally to an apparatus and a method of transferring sound as vibrations from outside on the lip through the cranial bones into the inner hearing organ in the brain, so the individual can perceive sound other than transferred through air into the ear. The sound via vibrations is transferred from outside the mouth to the inner hearing organ to the ear other than transferred through air thereto. The apparatus, which can be a mouth protector, grinding guard, snore avoidance tool or any other device located inside the mouth, is receiving the audio signal through wired or wireless signals (such as Bluetooth), and the signal is amplified and reproduced on a small "transducer" or vibrator, which will transform the signal into vibration waves that will be transported through the head bones and perceived by the inner section of the ear organ in the head.

Figure 2:
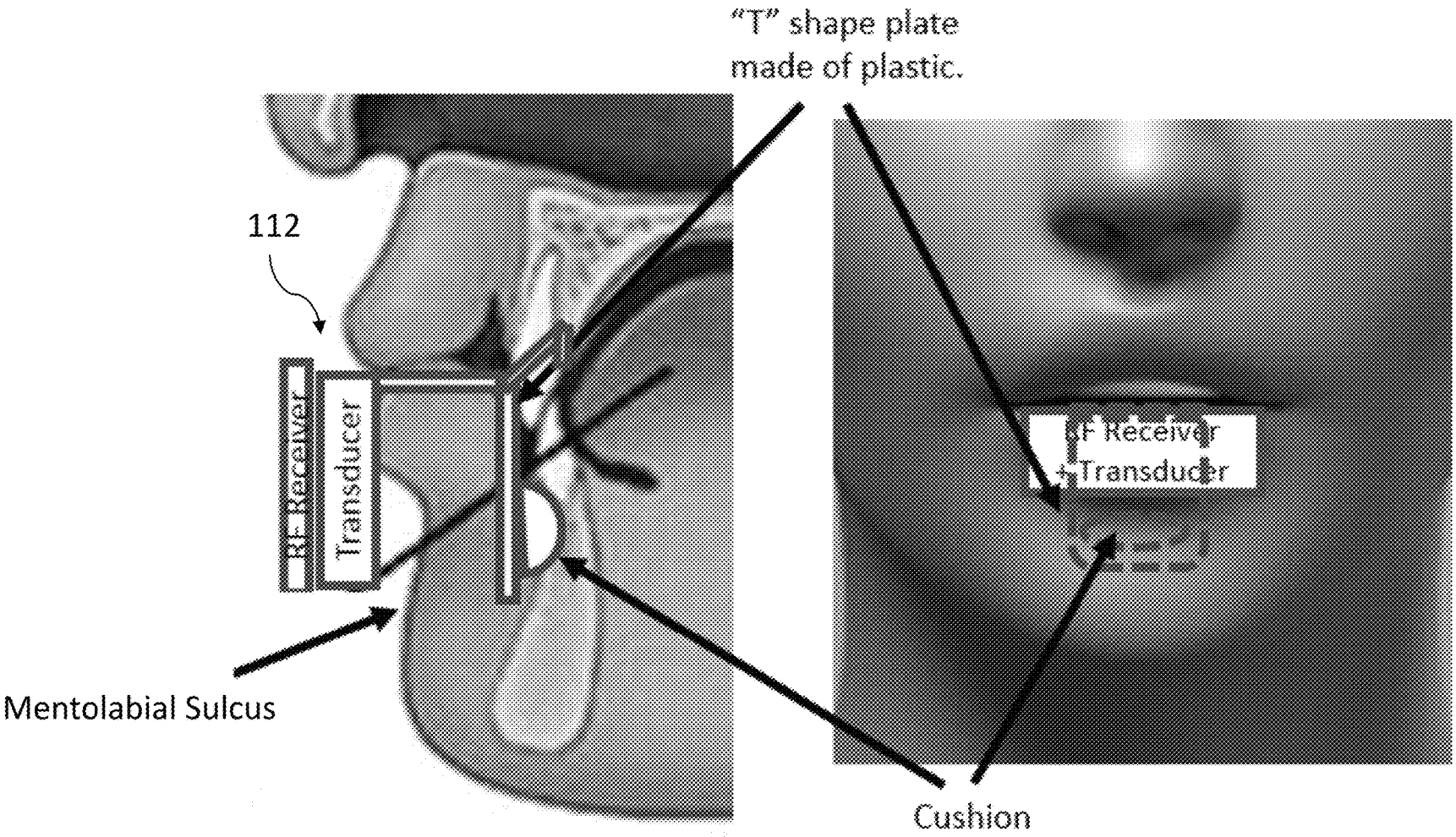
FIG. 2 is a schematic view of the mouth piece in the present invention mounted to an individual's mouth.
Figure 3:
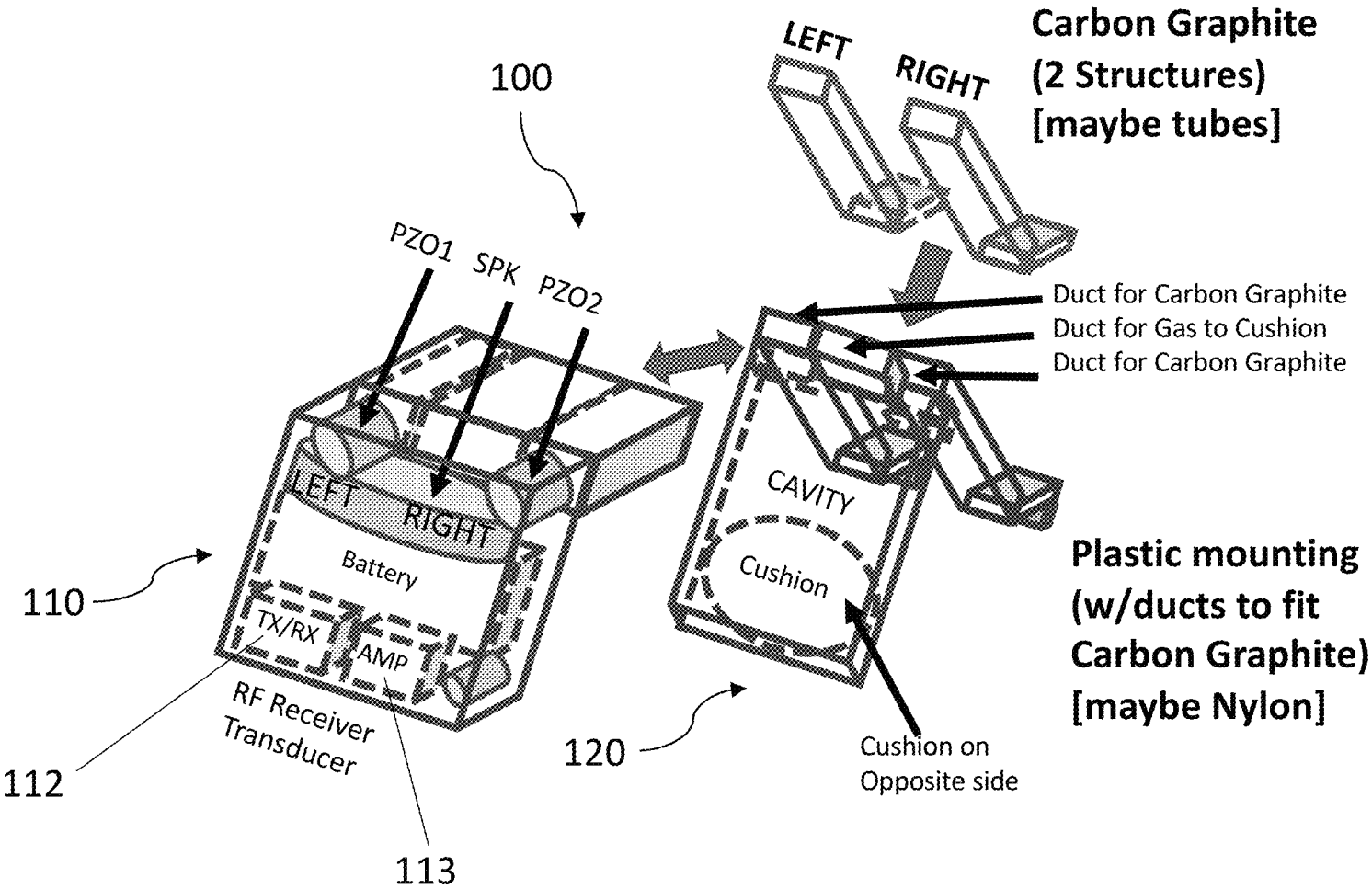
FIG. 3 is a partial exploded view of the mouth piece to transmit sound through vibration in the present invention.

In one aspect, as shown in FIGS. 1 to 3, a mouth piece 100 to transmit sound through vibration may include a front portion 110 and a rear portion 120, which are connected through a connecting unit 130 with each other to form a U-shaped apparatus. In one embodiment, the mouth piece 100 can be disposed traversing the lower lip as shown in FIG. 1. More specifically, the front portion 110 is disposed in front of the lower lip and the rear portion 120 is disposed between the lower lip and the gum behind the lower lip, while the connecting unit 130 is located between the upper lip and lower lip. The mouth piece 100 may further include an extending piece 131 extending from the rear portion into the mouth for the upper tooth and lower tooth to bite on.

In one embodiment, Bluetooth technology can be used to receive the sound signals from a source device, and the mouth piece 100 can electrically amplify the signals through an amplifier 111, so an efficient speaker 113 (small with relatively high output) is configured to create vibration on one or more transducers 112 located at the front portion 110. It is noted that the mouth piece is disposed 90% located outside the mouth, namely out next to the lower lip, and only 10% goes inside as a plate. The transducer 112 is outside of the mouth and only the plate goes inside between the "inner Labial Harvest site" and the "Front Gingivae" (gums), at the "Vermillion."

More specifically, the function of the transducer 112 is to reproduce the sound source(s) as vibrations that can be transmitted to the extending piece 131 and to at least one upper tooth and one lower tooth that bite on the extending piece 131. In one embodiment, the vibration can go to the Maxilla bone, the Sphenoid bone and the Mastoid bone, where vibrations are perceived by the individual or animal left and right hearing organs located in the brain.

It is noted that vibrations can not only be received by the upper tooth and the Maxilla bone, but also by the lower tooth and the Mandible bone. The individual or animal will be able to perceive the sound signal through vibrations generated by the transducers 112 on the mouth piece 100 in the present invention.

In one embodiment, the material used for the transducer 112 can be Nylon, but other materials that can minimize the degradation generated by the continuous friction of the teeth are also preferred. Also, a Left minus Right circuit can be added to the mouth piece 100 to enhance a stereo effect. The Left minus Right circuit can be created using the left and right channels amplifiers by adding a portion of the left signal to the input of the right amplifier and vise versa for the right signal.

The present invention is advantageous because it offers an alternative for perceiving sound from the mouth piece located mainly outside the mouth, and the sound can be transmitted through vibrations perceived by the hearing organ through teeth and bones in the brain. This sound transmission route will be more practical, convenient and efficient since sound waves transport more efficiently through fluids and solids than gasses line in the air.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A mouth piece to transmit sound through vibration comprising a front portion and a rear portion, which are connected through a connecting unit with each other to form a U-shaped apparatus, wherein the mouth piece is disposed traversing the lower lip; the front portion is disposed in front of the lower lip and the rear portion is disposed between the lower lip and the gum behind the lower lip, while the connecting unit is located between the upper lip and lower lip, and an extending piece extending from the rear portion into the mouth for the upper tooth and lower tooth to bite on to transmit sound through vibration.

2. The mouth piece to transmit sound through vibration of claim 1, wherein sound signals are received from a source device, and the mouth piece electrically amplifies the sound signals through an amplifier, and a speaker is configured to create vibration on one or more transducers located at the front portion, and the vibration can then be transmitted to the extending piece.

3. The mouth piece to transmit sound through vibration of claim 2, wherein the extending piece bit by at least one upper tooth and one lower tooth is configured to transmit the vibration to the Maxilla bone, the Sphenoid bone and the Mastoid bone, where vibrations are perceived by an individual or animal left and right hearing organs located in the brain.

4. The mouth piece to transmit sound through vibration of claim 2, wherein the extending piece bit by at least one lower tooth is configured to transmit the vibration through said at least one lower tooth to the Mandible bone.

5. The mouth piece to transmit sound through vibration of claim 1, wherein the transducer is made of Nylon.

* * * * *